US008588629B2

(12) United States Patent
Hiroi et al.

(10) Patent No.: US 8,588,629 B2
(45) Date of Patent: Nov. 19, 2013

(54) THERMALLY-ACTUATED SWITCH, FIXING DEVICE, AND IMAGE FORMING APPARATUS

(75) Inventors: Atsushi Hiroi, Kanagawa (JP); Katsuya Saito, Kanagawa (JP); Toshihiko Mitsuhashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 149 days.

(21) Appl. No.: 13/274,986

(22) Filed: Oct. 17, 2011

(65) Prior Publication Data

US 2012/0251137 A1 Oct. 4, 2012

(30) Foreign Application Priority Data

Mar. 28, 2011 (JP) ..... 2011-070893

(51) Int. Cl.
*G03G 15/20* (2006.01)
*H01H 37/00* (2006.01)

(52) U.S. Cl.
USPC ..... 399/33; 337/298

(58) Field of Classification Search
USPC ..... 399/33, 67, 69, 320, 328, 329; 219/216; 337/298, 333, 343, 348, 354
See application file for complete search history.

(56) References Cited

U.S. PATENT DOCUMENTS

| | | | | |
|---|---|---|---|---|
| 5,596,307 | A * | 1/1997 | Hayashi et al. | 337/298 |
| 2007/0098418 | A1* | 5/2007 | Kang et al. | 399/33 |
| 2012/0251136 | A1* | 10/2012 | Masumura et al. | 399/33 |

FOREIGN PATENT DOCUMENTS

| | | |
|---|---|---|
| JP | A-8-7729 | 1/1996 |
| JP | A-10-40790 | 2/1998 |
| JP | A-2002-319343 | 10/2002 |
| JP | A-2009-231074 | 10/2009 |

* cited by examiner

*Primary Examiner* — Sophia S Chen
(74) *Attorney, Agent, or Firm* — Oliff & Berridge, PLC

(57) ABSTRACT

A thermally-actuated switch includes a movable member that is provided between a second electrode and a displacement member so as to be movable in a first direction, is pushed at one end by the displacement member in a concave state to push the second electrode at the other end to bring a second contact into contact with a first contact, and is moved in the first direction by an urging force acting on the second electrode due to convex displacement of the displacement member, and a regulating member that regulates movement of the movable member in a second direction orthogonal to the first direction from a transmittable position where a pushing force from the displacement member is capable of being transmitted to the second electrode, and releases the regulation such that the movable member moved in the first direction by the urging force is removed from the transmittable position.

4 Claims, 10 Drawing Sheets

THERMALLY-ACTUATED SWITCH, FIXING DEVICE, AND IMAGE FORMING APPARATUS

CROSS-REFERENCE TO RELATED APPLICATIONS

This application is based on and claims priority under 35 USC 119 from Japanese Patent Application No. 2011-070893 filed Mar. 28, 2011.

BACKGROUND

Technical Field

The present invention relates to a thermally-actuated switch, a fixing device, and an image forming apparatus.

SUMMARY

According to an aspect of the invention, there is provided a thermally-actuated switch including: a housing; a displacement member that is held by the housing in a concave shape with respect to the outside of the housing and is displaced in a convex shape with respect to the outside of the housing in response to temperature changes; a first electrode that has a first contact provided inside the housing; a second electrode that has a second contact provided between the displacement member and the first contact and that is urged such that the second contact is separated from the first contact to the displacement member side; a movable member that is provided between the second electrode and the displacement member so as to be movable in a first direction directed from the second electrode side to the displacement member side, is pushed at one end by the displacement member in a concave state to push the second electrode at the other end to bring the second contact into contact with the first contact, and is moved in the first direction by an urging force acting on the second electrode due to convex displacement of the displacement member; and a regulating member that regulates movement of the movable member in a second direction orthogonal to the first direction from a transmittable position where a pushing force from the displacement member is capable of being transmitted to the second electrode, and releases the regulation such that the movable member moved in the first direction by the urging force is removed from the transmittable position.

BRIEF DESCRIPTION OF THE DRAWINGS

Exemplary embodiments of the present invention will be described in detail based on the following figures, wherein:

FIG. 4A shows the thermostat in a case where the temperature of a heating roll (the inside of a housing) is within a range of a predetermined temperature (normal operation temperature), and FIG. 4B shows the thermostat in a case where the temperature of the heating roll (the inside of the housing) exceeds the predetermined temperature (normal operation temperature);

DETAILED DESCRIPTION

Hereinafter, an example of an exemplary embodiment related to the invention will be described with reference to the drawings.

(Configuration of Image Forming Apparatus Related to Present Exemplary Embodiment)

Figure 1:
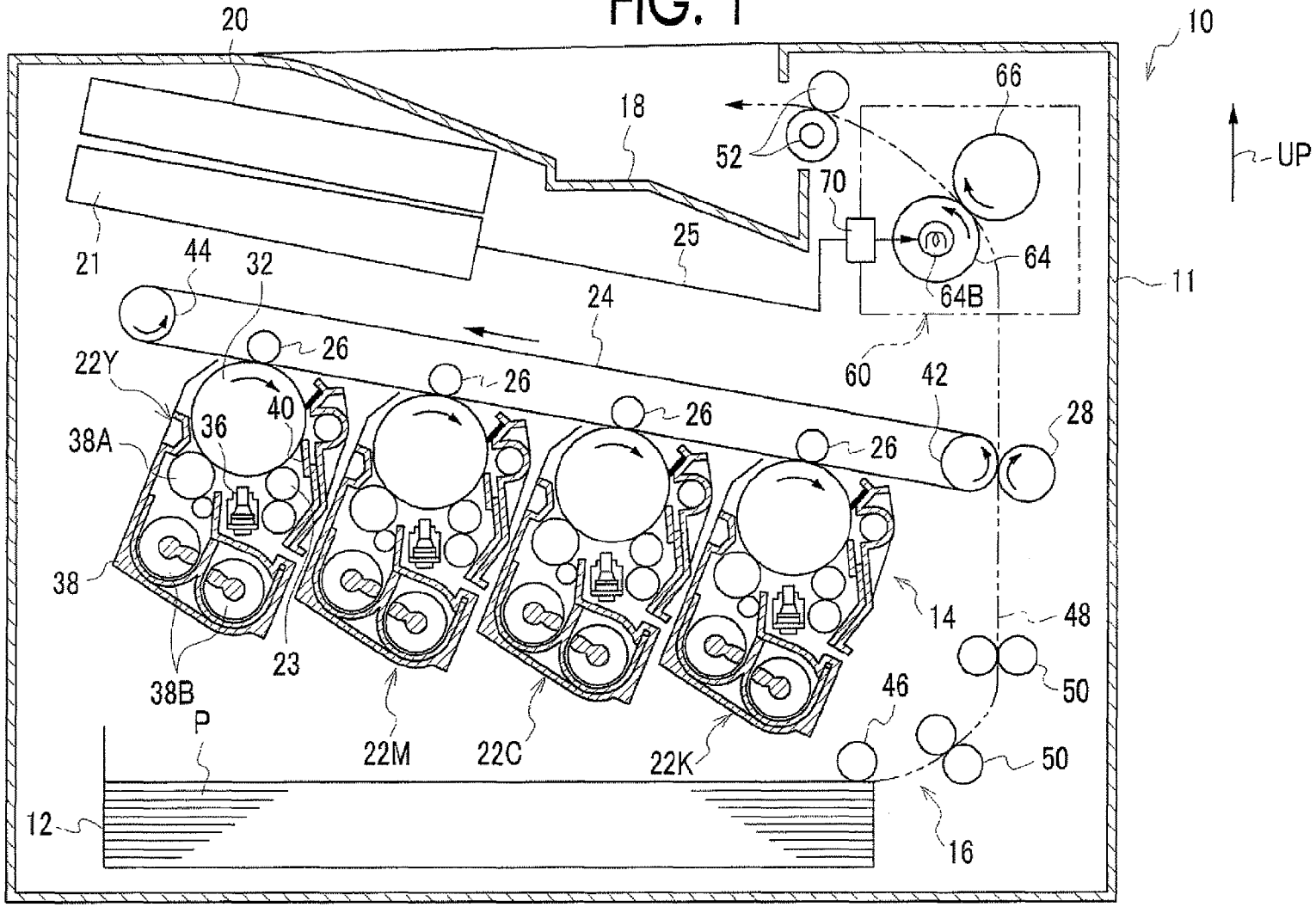
FIG. 1 is a schematic view showing the configuration of an image forming apparatus related to the present exemplary embodiment.

First, the configuration of an image forming apparatus related to the present exemplary embodiment will be described. FIG. 1 is a schematic view showing the configuration of the image forming apparatus related to the present exemplary embodiment. In addition, an arrow UP shown in the drawing indicates the upper side in the vertical direction.

The image forming apparatus 10, as shown in FIG. 1, includes an image forming apparatus body 11 in which individual component parts are accommodated. An accommodating section 12 in which recording media P, such as paper, are accommodated, an image forming section 14 that forms an image on a recording medium P, a transporting section 16 that transports the recording medium P to the image forming section 14 from the accommodating section 12, a control section 20 that controls the operation of the individual sections of the image forming apparatus 10, a power supply section 21 that supplies electric power to the individual sections of the image forming apparatus 10 are provided inside the image forming apparatus body 11. Additionally, a discharge section 18 to which a recording medium P on which an image is formed by the image forming section 14 is discharged is provided at an upper part of the image forming apparatus body 11.

The image forming section 14 includes image forming units 22Y, 22M, 22C, and 22K (hereinafter represented by 22Y to 22K) that forms toner images in individual colors of yellow (Y), magenta (M), cyan (C), and black (K), an intermediate transfer belt 24 to which toner images formed by the image forming units 221 to 22K are transferred, a first transfer roll 26 that transfers the toner images formed by the image forming units 22Y to 22K to the intermediate transfer belt 24, a second transfer roll 28 that transfers the toner images transferred to the intermediate transfer belt 24 by the first transfer roll 26 from the intermediate transfer belt 24 to a recording medium P. In addition, the image forming section 14 is not limited to the above configuration, and may have other configurations. Arbitrary image forming sections that form an image on a recording medium P may be adopted.

The image forming units 22Y to 22K are arranged side by side at a central portion of the image forming apparatus 10 in an up-and-down direction in an inclined state with respect to the horizontal direction. Additionally, the image forming units 22Y to 22K have photoreceptors 32 that rotate in one direction (for example, in the clockwise direction in FIG. 1), respectively. In addition, since the image forming units 22Y to 22K are similarly configured, reference numerals of individual parts of the image forming units 22M, 22C, and 22K are omitted in FIG. 1.

A charging roll 23 as an example of a charging device that charges the photoreceptor 32, an exposure device 36 that exposes the photoreceptor 32 charged by the charging roll 23 to forms an electrostatic latent image on the photoreceptor 32, a developer unit 38 that develops the electrostatic latent image formed on the photoreceptor 32 by the exposure device 36 to form a toner image, and a removal member 40 that comes into contact with the photoreceptor 32 to remove the toner that remains on the photoreceptor 32 are provided sequentially from the upstream in the rotational direction of the photoreceptor 32 around each photoreceptor 32.

The exposure device 36 forms an electrostatic latent image on the basis of an image signal sent from the control section 20. As the image signal sent from the control section 20, for example, there is an image signal that the control section 20 acquires from an external device.

The developer unit 38 includes a developer supply body 38A that supplies a developer to the photoreceptor 32, and plural carrying members 38B that carry a developer to be supplied to the developer supply body 38A while stirring the developer.

The intermediate transfer belt 24 is annularly formed, and is arranged above the image forming units 22Y to 22K. Winding rolls 42 and 44 around which the intermediate transfer belt 24 is wound are provided on the inner peripheral side of the intermediate transfer belt 24. The intermediate transfer belt 24 circulates and moves (rotates) in one direction (for example, in the counterclockwise direction in FIG. 1), coming into contact with the photoreceptor 32, as either of the winding rolls 42 and 44 is rotationally driven. In addition, the winding roll 42 is formed as a facing roll that faces the second transfer roll 28.

The first transfer roll 26 faces the photoreceptor 32 across the intermediate transfer belt 24. A position between the first transfer roll 26 and the photoreceptor 32 becomes a first transfer position where a toner image formed on the photoreceptor 32 is transferred to the intermediate transfer belt 24.

The second transfer roll 28 faces the winding roll 42 across the intermediate transfer belt 24. A position between the second transfer roll 28 and the winding roll 42 becomes a second transfer position where a toner image transferred to the intermediate transfer belt 24 is transferred to a recording medium P.

The transporting section 16 is provided with a delivery roll 46 that delivers recording media P accommodated in the accommodating section 12, a transporting path 48 along which a recording medium P delivered to the delivery roll 46 is transported, and plural transporting rolls 50 that are arranged along the transporting path 48 to transport a recording medium P delivered by the delivery roll 46 to the second transfer position.

A fixing device 60 that fixes a toner image formed on a recording medium P by the image forming section 14 onto the recording medium P is provided on the downstream side of the second transfer position in the transporting direction. A discharge roll 52 that discharges a recording medium P, on which a toner image is fixed, to the discharge section 18 is provided on the downstream side of the fixing device 60 in the transporting direction. In addition, the specific configuration of the fixing device 60 will be described below.

Next, the image formation operation of forming an image on a recording medium P in the image forming apparatus 10 related to the present exemplary embodiment will be described.

In the image forming apparatus 10 related to the present exemplary embodiment, a recording medium P delivered from the accommodating section 12 by the delivery roll 46 is delivered to the second transfer position by the plural transporting rolls 50.

On the other hand, in the image forming units 22Y to 22K, the photoreceptor 32 charged by the charging roll 23 is exposed by the exposure device 36, and an electrostatic latent image is formed on the photoreceptor 32. The electrostatic latent image is developed by the developer unit 38, and a toner image is formed on the photoreceptor 32. Individual color toner images formed by the image forming units 22Y to 22K are superimposed on the intermediate transfer belt 24 at the first transfer position, whereby a color image is formed. The color images formed on the intermediate transfer belt 24 are transferred to a recording medium P at the second transfer position.

The recording medium P to which the toner images are transferred is transported to the fixing device 60, and the transferred toner images are fixed by the fixing device 60. The recording medium P on which the toner images are fixed is discharged to the discharge section 18 by the discharge roll 52. As described above, a series of image formation operations is performed.

(Configuration of Fixing Device 60 Related to Present Exemplary Embodiment)

Figure 2:
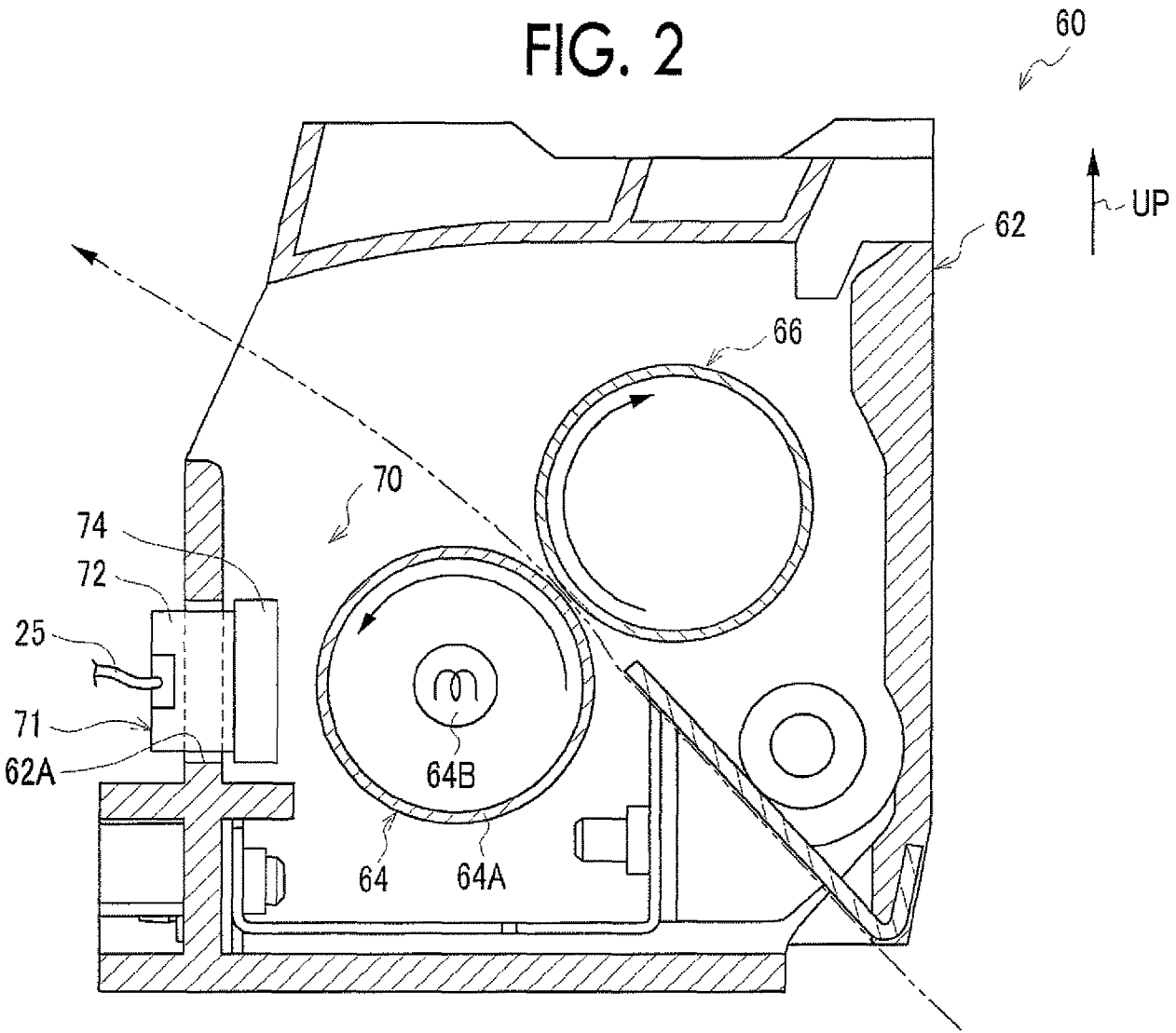
FIG. 2 is a cross-sectional view showing the configuration of a fixing device related to the present exemplary embodiment.

Next, the configuration of the fixing device 60 related to the present exemplary embodiment will be described. FIG. 2 is a schematic view showing the configuration of the fixing device 60 related to the present exemplary embodiment. In addition, an arrow UP shown in the drawing indicates the upper side in the vertical direction.

The fixing device 60 related to the present exemplary embodiment, as shown in FIG. 2, includes a housing 62 that is provided so as to be attachable to and detachable from the image forming apparatus body 11 (refer to FIG. 1) and has individual component parts provided therein. A heating roll 64 as an example of a heating member that heats an image on a recording medium, and a pressure belt 66 as an example of pressure member are provided inside the housing 62.

The heating roll 64 includes a cylindrical member 64A, and a heat source 64B, such as a halogen lamp, which is provided in an internal space of the cylindrical member 64A. The cylindrical member 64A is formed from metallic materials, such as aluminum and stainless steel.

The heat source 64B is electrically connected to the power supply section 21 by an electric circuit 25 as an example of a circuit for supplying electric power to the heating roll (heat source 64B). Thereby, the heat source 64B is configured such that electric power is supplied through the electric circuit 25 from the power supply section 21.

The pressure belt 66 rotates across a recording medium P between the pressure belt and the heating roll 64, and is constituted as an annular transporting belt that transports the recording medium P while pressurizing the recording medium.

On the recording medium P transported while being pinched by the heating roll 64 and the pressure belt 66, a toner is heated by the heating roll 64 and pressurized by the pressure belt 66 such that an image is fixed in a contact region between the heating roll 64 and the pressure belt 66. In addition, in FIG. 2, a transporting path along which a recording medium P is transported by the heating roll 64 and the pressure belt 66 is shown by a two-dot chain line.

The housing 62 of the fixing device 60 is provided with a thermostat 70 as an example of a thermally-actuated switch. Specifically, the thermostat 70 is provided in the housing 62 of the fixing device 60 such that a bimetal 76 (refer to FIG. 3) that will be described below has a predetermined gap from the heating roll 64 toward the heating roll 64 side. As shown in FIG. 1, the thermostat 70 is provided within the electric circuit 25, and is configured so as to interrupt the electric circuit 25 to stop supply of electric power to the heat source 64B from the power supply section 21, when the temperature of the heating roll 64 (the inside of the housing 62) becomes a predetermined temperature.

(Specific Configuration of Thermostat 70 Related to Present Exemplary Embodiment)

Figure 3:
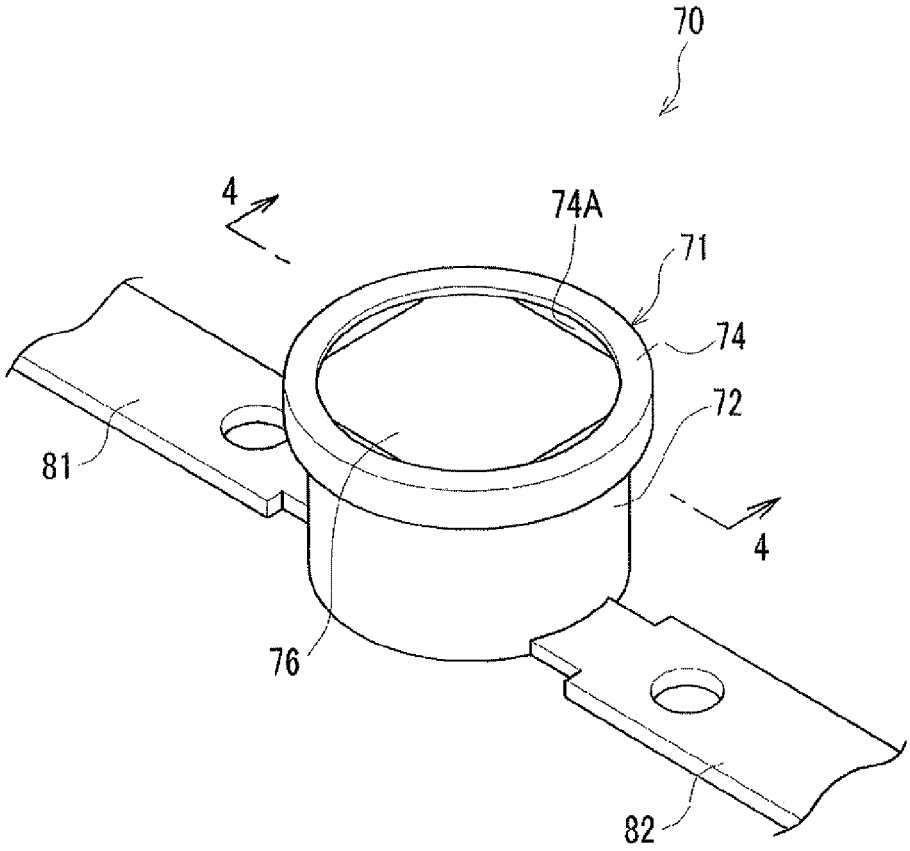
FIG. 3 is an external view showing the appearance of a thermostat related to the present exemplary embodiment.

Next, the specific configuration of the thermostat 70 related to the present exemplary embodiment will be described. FIGS. 3 to 5 are schematic views showing the configuration of the thermostat 70.

The thermostat 70 related to the present exemplary embodiment, as shown in FIGS. 2 and 3, includes an apparatus body 71 inserted into an insertion hole 62A formed in the housing 62 of the fixing device 60. The apparatus body 71 is inserted into the insertion hole 62A, and thereby attached to the housing 62 of the fixing device 60.

Figure 4A:
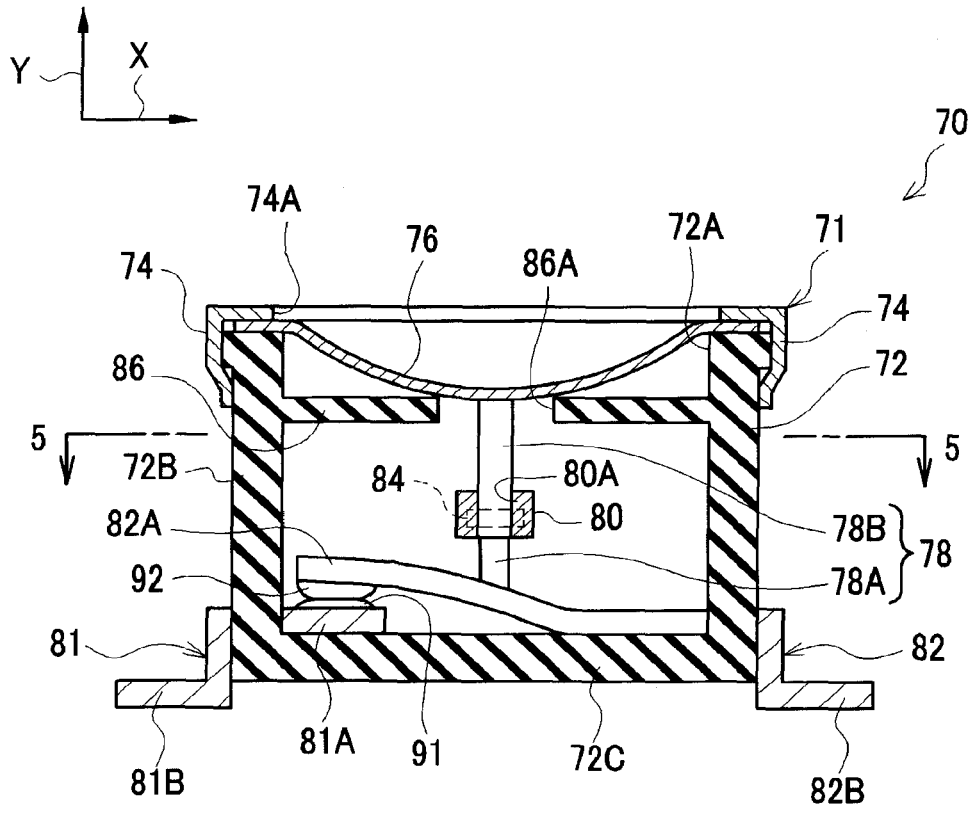
FIGS. 4A and 4B are cross-sectional views taken along a line 4-4 in FIG. 3.
Figure 4B:
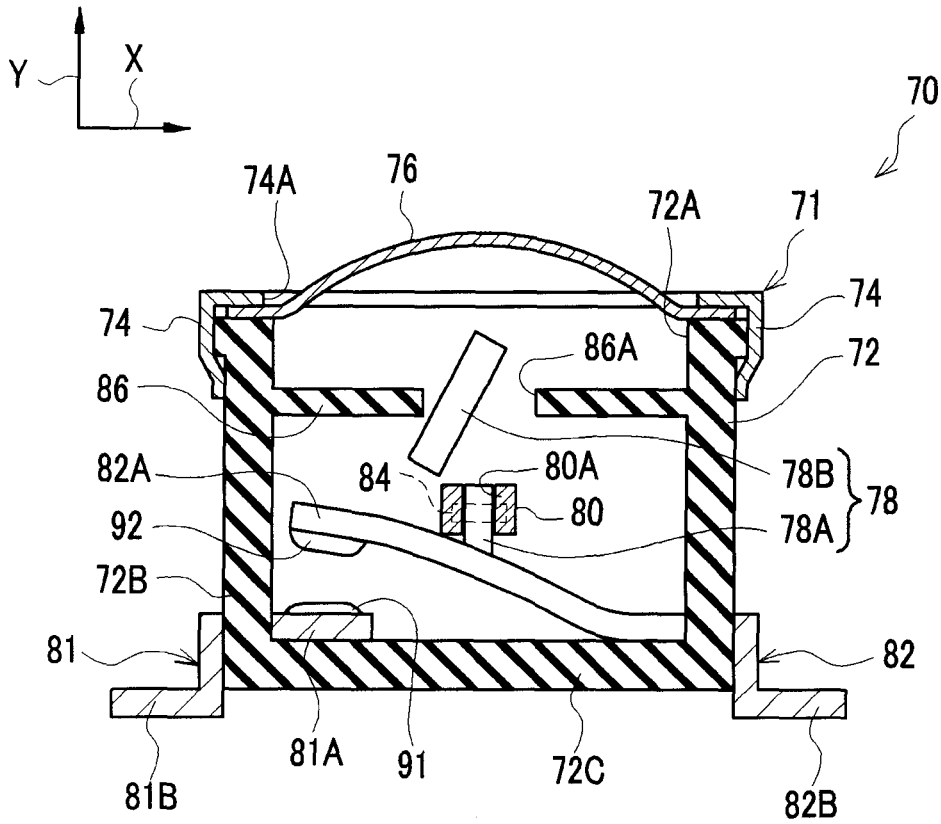
Figure 5:
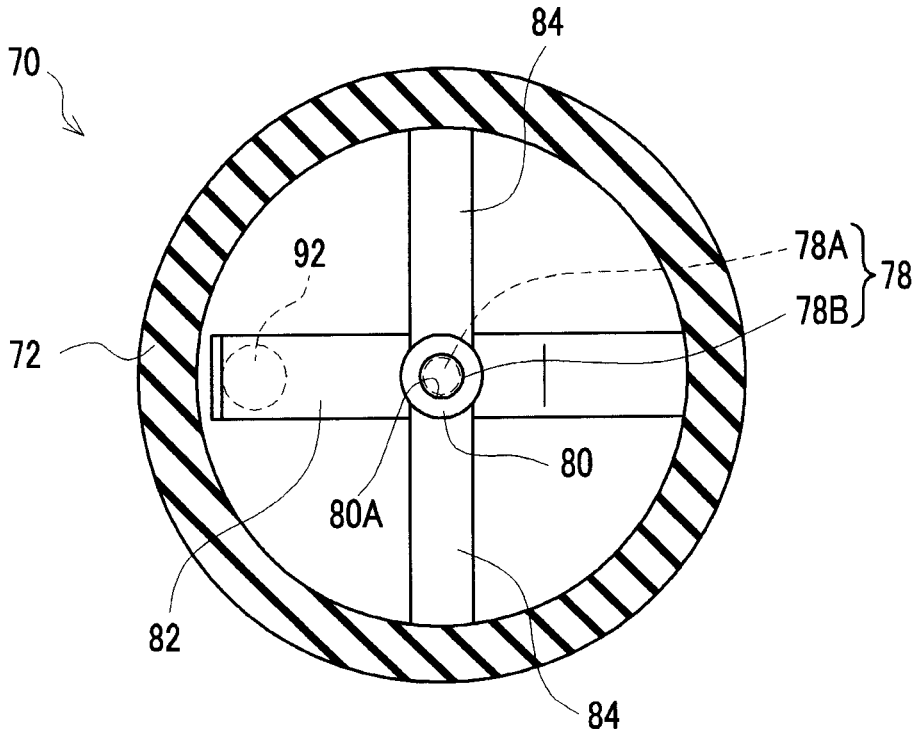
FIG. 5 is a cross-sectional view taken along a line 5-5 in FIG. 4A.

As shown in FIGS. 3 to 4B, the apparatus body 71 of the thermostat 70 includes a cylindrical housing 72 that has an open portion 72A (refer to FIGS. 4A and 4B) of which one end (upper end in FIGS. 4A and 4B) is opened, a cap 74 as an example of a holding member that is provided at the open portion 72A of the housing 72, and a first electrode 81 and a second electrode 82 that are provided at the housing 72.

The housing 72 is made of materials having insulation properties. As the materials having insulation properties, for example, ceramics, phenol resin, polyphenylene sulfide, and the like are used. In addition, the shape and material of the housing 72 are not limited to the above.

The open portion 72A of the housing 72 is provided with the bimetal 76 as an example of a displacement member that is displaced in response to temperature changes. The bimetal 76 is formed in the shape of a disc spring (diaphragm), and is held by the housing 72 in a concave shape with respect to the outside of the housing 72 by the cap 74 (a state shown in FIG. 4A). Additionally, the bimetal 76 is configured by joining two kinds of metals with different coefficients of linear expansion, and if the bimetal has a predetermined temperature, the bimetal is displaced (reversed) in a convex shape (a state shown in FIG. 4B) with respect to the outside of the housing 72.

As shown in FIG. 3, a circular opening 74A through which the surface of the bimetal 76 is exposed to the outside is formed at a central portion of the cap 74 in plan view. The cap 74 is caulked to the housing 72 and thereby fixed to the housing 72.

The first electrode 81, as shown in FIGS. 4A and 4B, is constituted by a plate-shaped electrode that has the radial (the direction of an arrow X in FIGS. 4A and 4B) length of the housing 72, and has heat resistance and conductivity. One end 81A of the first electrode 81 is arranged inside the housing 72, and is fixed to a bottom wall 72C of the housing 72 in the vicinity of a side wall 72B of the housing 72 radially outside the central portion of the housing 72 in plan view. The first electrode 81 is bent in a longitudinal intermediate portion, and the other end 81B thereof is pulled out to the outside of the housing 72.

The first electrode 81 has a first contact 91 at one end 81A arranged inside the housing 72. The first contact 91 is directed to the bimetal 76 side (the direction of an arrow Y in FIGS. 4A and 4B).

The second electrode 82 is constituted by a plate-shaped electrode that has the radial (the direction of the arrow Y in FIGS. 4A and 4B) length of the housing 72, and has heat resistance and conductivity. The second electrode 82 has one end 82A arranged between the first contact 91 inside the housing 72 and the bimetal 76 and bent at a longitudinal intermediate portion thereof, and has the other end 82B pulled out to the outside of the housing 72.

The second electrode 82 has a second contact 92 at one end 82A arranged between the bimetal 76 and the first contact 91. The second electrode 82 is urged such that the second contact 92 is separated from the first contact 91 to the bimetal 76 side (the direction of the arrow Y in FIGS. 4A and 4B). Specifically, the second electrode 82 is constituted by a flat spring, and is urged so as to be separated to the bimetal 76 side with respect to the first electrode 81 by its own elastic force. Accordingly, as a resisting force that pushes the second electrode 82 to the first contact 91 against the urging force acts on the second electrode, the second contact 92 comes into contact with the first contact 91, and the resisting force stops acting such that the second contact is separated from the first contact 91 to the bimetal 76 side.

In addition, as a member (electrode) having heat resistance, conductivity, and elasticity (spring property), for example, members made of stainless steel, copper, phosphor bronze, or the like or members obtained by plating these members with tin, nickel, silver, or gold are used.

A movable pin 78 as an example of a movable member, which is provided so as to be movable in a first direction (the direction of the arrow Y in FIGS. 4A and 4B) that is directed to the bimetal 76 side from the second electrode 82 side is provided between the second electrode 82 and the bimetal 76. In addition, this first direction is also the axial direction of the housing 72.

The movable pin 78 includes a first pin 78A as an example of a first member fixed to the second electrode 82, and a second pin 78B as an example of a second member provided between the first pin 78A and the bimetal 76.

The first pin 78A has the (the direction of the arrow Y in FIGS. 4A and 4B) axial length of the housing 72, and is formed in a columnar shape, for example. As shown in FIG. 5, the first pin 78A is arranged at the central portion (center portion) of the housing 72 in plan view, and is fixed to the face (top face in FIGS. 4A and 4B) of the second electrode 82 on the bimetal 76 side. Thereby, the first pin 78A moves integrally with the second electrode 82.

The second pin 78B has the (the direction of the arrow Y in FIGS. 4A and 4B) axial length of the housing 72, and is formed in a columnar shape, for example. The second pin 78B, as shown in FIG. 5, is arranged at the central portion (center portion) of the housing 72 in plan view. The second pin 78B is not fixed to any members, unlike the first pin 78A. The diameter of the second pin 78B is made larger than the diameter of the first pin 78A.

A first pin guide 80 as an example of a regulating member, which regulates movement of the second pin 78B in a second direction (the direction of the arrow X in FIGS. 4A and 4B) orthogonal to the first direction (the direction of the arrow Y in FIGS. 4A and 4B), is provided at the central portion of the housing 72. In addition, this second direction is also the radial direction of the housing 72.

The first pin guide 80, as shown in FIGS. 4A and 4B, is formed in the shape of a cylinder that has an insertion hole 80A that penetrates in the first direction (the direction of the arrow Y in FIGS. 4A and 4B) and has the second pin 78B inserted thereinto.

In a state where the second pin 78B is inserted into the first pin guide 80, movement of the second pin in the first direction (the direction of the arrow Y in FIGS. 4A and 4B) along the insertion hole 80A of the first pin guide 80 is permitted, and movement of the second pin in the second direction (the direction of the arrow X in FIGS. 4A and 4B) is regulated by hitting the inner wall of the first pin guide 80 so that the second pin is located at a position where a pushing force from the bimetal 76 can be transmitted to the second electrode 82.

The first pin guide 80 is provided with a supporting portion 84 that supports the first pin guide 80. Specifically, the supporting portions 84, as shown in FIG. 5, are provided in a pair in the radial direction outside the first pin guide 80 across the first pin guide 80.

The pair of supporting portions 84 is provided so as to extend from the outer peripheral surface of the first pin guide 80 to the inner peripheral side of the side wall 72B of the housing 72 in the direction orthogonal to the length direction of the second electrode 82 and in the radial direction of a housing 72, respectively. One end of each of the pair of supporting portions 84 is fixed to the outer peripheral surface of the first pin guide 80, and the other end of each of the pair of supporting portions 84 is fixed to the inner peripheral surface of the side wall 72B of the housing 72. Thereby, the first pin guide 80 is supported by the supporting portions 84.

A second pin guide 86 that guides the second pin 78B in the axial direction (the direction of the arrow Y in FIGS. 4A and 4B) of the housing 72 is provided between the first pin guide 80 and the bimetal 76, inside the housing 72. The second pin guide 86 is formed in the shape of a cylinder that has an insertion hole 86A that penetrates in the axial direction (the direction of the arrow Y in FIGS. 4A and 4B) of the housing 72 and has the second pin 78B inserted thereinto. The diameter of the insertion hole 86A is made larger than the diameter of the insertion hole 80A of the first pin guide 80, and is set to a diameter such that the second pin 78B can be inclined within the insertion hole 86A.

Here, in the present exemplary embodiment, the second pin 78B has one end (upper end in FIGS. 4A and 4B) pushed by the bimetal 76 in a concave state (state shown in FIG. 4A) that is made concave with respect to the outside of the housing 72, thereby pushing the second electrode 82 via the first pin 78A at the other end (lower end in FIGS. 4A and 4B) so as to bring the second contact 92 and the first contact 91 into contact with each other.

Additionally, in a case where the bimetal 76 is in a concave state, the second pin 78B has the end on the first pin 78A (lower end in FIGS. 4A and 4B) side inserted into the insertion hole 80A of the first pin guide 80, and the movement of the second pin 78B in the second direction (the direction of the arrow X in FIGS. 4A and 4B) is regulated by the first pin guide 80.

A resisting force against the urging force of the second electrode 82 stops acting on the second pin 78B due to the convex displacement (state shown in FIG. 413) of the bimetal 76, whereby the second pin 78B is pushed by the first pin 78A that is moved to the bimetal 76 side with an urging force of the second electrode 82, and the regulation of the second pin 78B from the first pin guide 80 is released. Specifically, the first pin 78A that is moved to the bimetal 76 side with an urging force of the second electrode 82 is inserted into the insertion hole 80A of the first pin guide 80 so as to push out the second pin 78B from the insertion hole 80A of the first pin guide 80.

In addition, when the first pin 78A is inserted into the insertion hole 80A of the first pin guide 80 due to the restoration of the second electrode 82, the first pin 78A is set to a length such that the first pin 78A is located on the same plane as the surface (top face in FIGS. 4A and 4B) of the first pin guide 80 on the bimetal 76 side or protrudes to the bimetal 76 side more than the surface concerned.

Additionally, the second pin guide 86 is used also as guide member that guides the second pin 78B when the second pin is installed inside the housing 72. As the thermostat 70 of the present exemplary embodiment, a configuration in which the second pin guide 86 is not provided may be adopted.

(Action Related to Present Exemplary Embodiment)

Next, the operation related to the present exemplary embodiment will be described.

According to the configuration of the present exemplary embodiment, in a case where the temperature of the heating roll (the inside of the housing 62) is within a range of a predetermined temperature (normal operation temperature), as shown in FIG. 4A, the bimetal 76 is in a concave state where the bimetal is made concave with respect to the outside of the housing 72.

In this case, the second pin 78B is inserted into the insertion hole 80A of the first pin guide 80, and is located at a position where a pushing force from bimetal 76 can be transmitted to the second electrode 82, and the second pin 78B is pushed by the bimetal 76 at one end (the upper end in FIGS. 4A and 4B) to push the second electrode 82 via the first pin 78A at the other end (the lower end in FIGS. 4A and 4B) of the second pin 78B, to bring the second contact 92 and the first contact 91 into contact with each other. Thereby, the electric circuit 25 is not interrupted and supply of electric power from the power supply section 21 through the electric circuit 25 to the heat source 64B is made.

Here, in the fixing device 60, if the temperature of the heating roll 64 (the inside of the housing 62) becomes a high temperature exceeding a predetermined temperature (normal operation temperature), as shown in FIG. 4B, the bimetal 76 is displaced (reversed) in a convex shape with respect to the outside of the housing 72.

If the bimetal 76 is displaced (reversed) in a convex shape with respect to the outside of the housing 72, a resisting force against the urging force of the second electrode 82 stops acting, the second contact 92 moves to the bimetal 76 side by the urging force of the second electrode 82, and the second contact 92 and the first contact 91 are separated from each other. Thereby, the electric circuit 25 is interrupted and the supply of electric power from the power supply section 21 to the heat source 64B is stopped.

At this time, the first pin 78A is inserted into the insertion hole 80A of the first pin guide 80 to push out the second pin 78B from the first pin guide 80. Thereby, the second pin 78B jumps out of the first pin guide 80, is released from the movement regulation of the first pin guide 80, and is removed from the first pin guide 80. That is, the second pin 78B slips out of the first pin guide 80, and is thereby removed from a position where the pushing force from the bimetal 76 can be transmitted to the second electrode 82. Thereby, the first pin 78A inclines with respect to the first direction (the direction of the arrow Y in FIGS. 4A and 4B) or falls downward due to its own weight.

In this state, even in a case where the reversed bimetal 76 is pushed and is returned from the outside, the second pin 78B is not pushed by the bimetal 76, or is not inserted into the first pin guide 80 even if pushed. For this reason, the first pin 78A is not pushed by the second pin 78B, and the second contact 92 of the second electrode 82 and the first contact 91 of the first electrode 81 do not come into contact with each other. That is, even if the bimetal 76 is returned to a concave shape due to an external force, the interrupted state of the electric circuit 25 is maintained.

Figure 6:
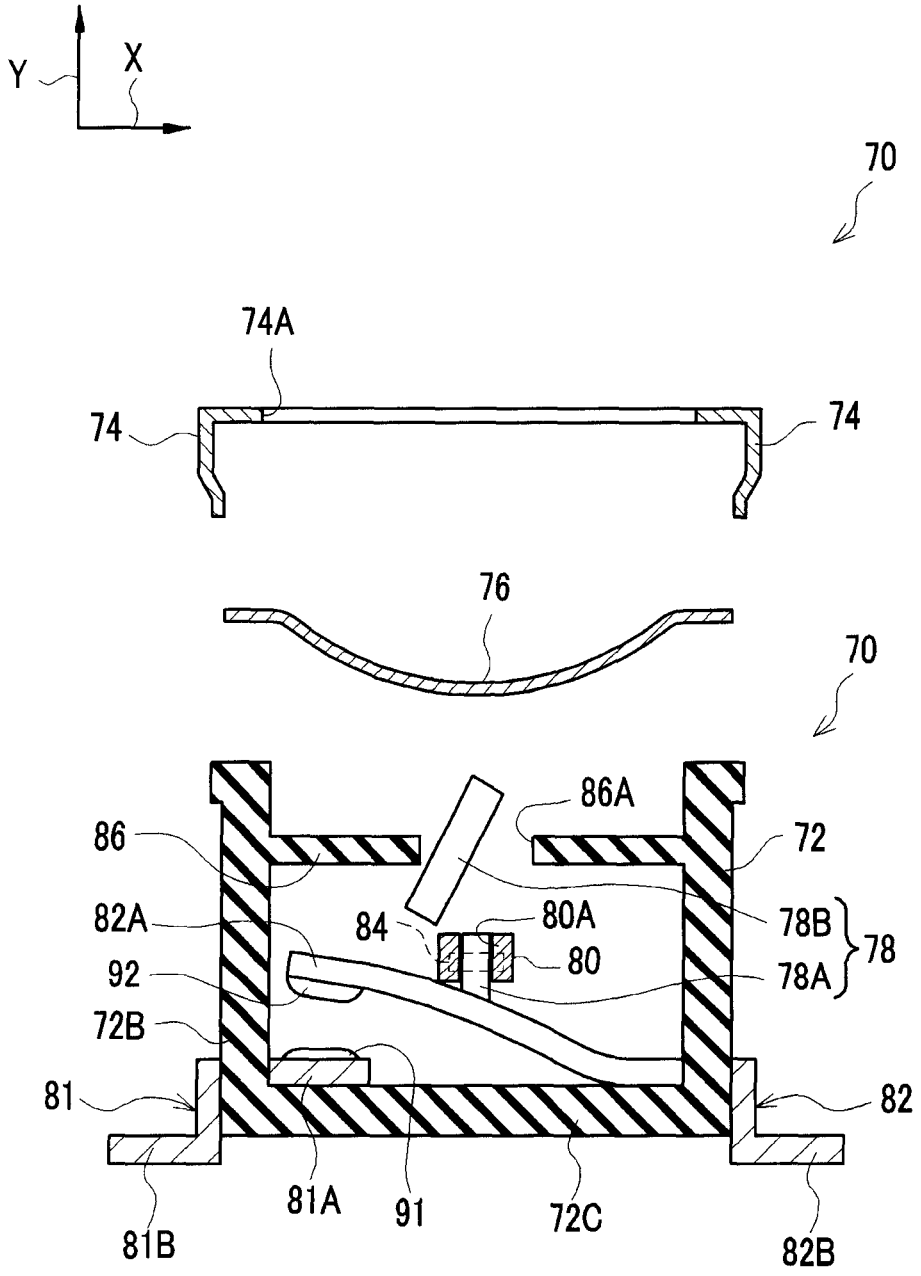
FIG. 6 is a schematic view showing a state where a cap is detached from the housing, in the thermostat related to the present exemplary embodiment.

In addition, in the present exemplary embodiment, even if the temperature of the heating roll 64 (the inside of the housing 62) does not become a high temperature more than a predetermined temperature (normal operation temperature), as shown in FIG. 6, in a case where the cap 74 that holds the bimetal 76 is detached from the housing 72 due to damage or the like, the resisting force against the urging force of the second electrode 82 stops acting. Therefore, the second contact 92 moves to the bimetal 76 side by the urging force of the second electrode 82, and the second contact 92 and the first contact 91 are separated from each other. Thereby, the electric circuit 25 is interrupted and the supply of electric power from the power supply section 21 to the heat source 64B is stopped.

(Modifications)

Next, a modification will be described.

Figure 7A:
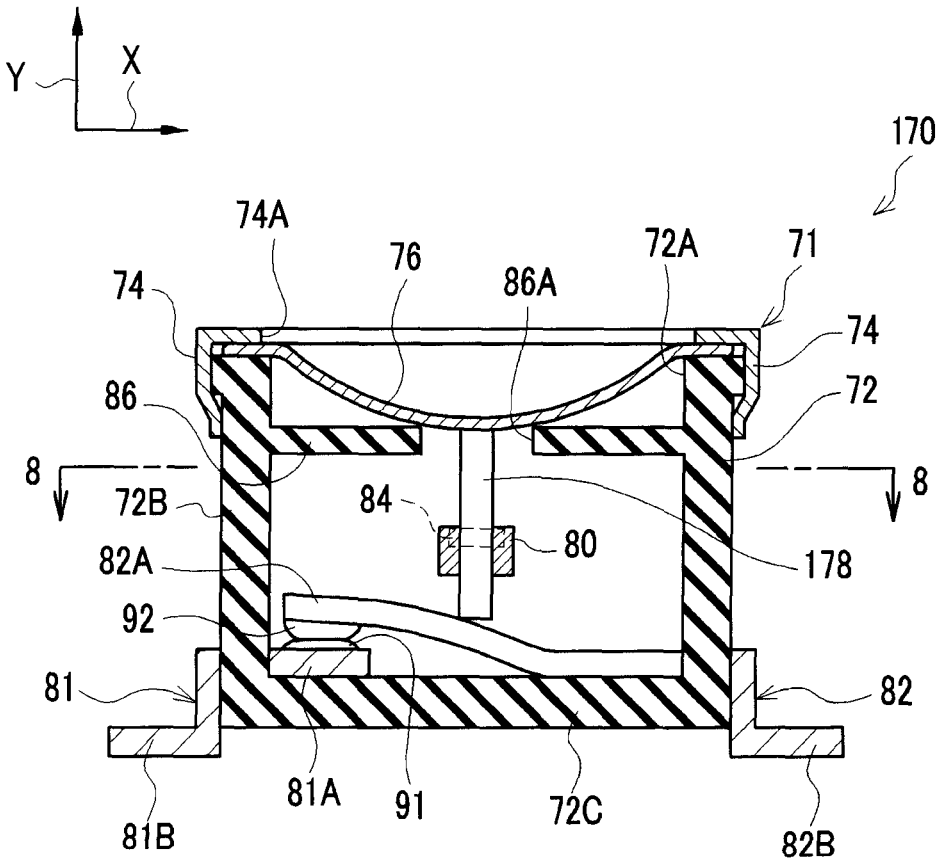
FIGS. 7A and 7B are schematic views showing the configuration of a thermostat related to a modification.
Figure 7B:
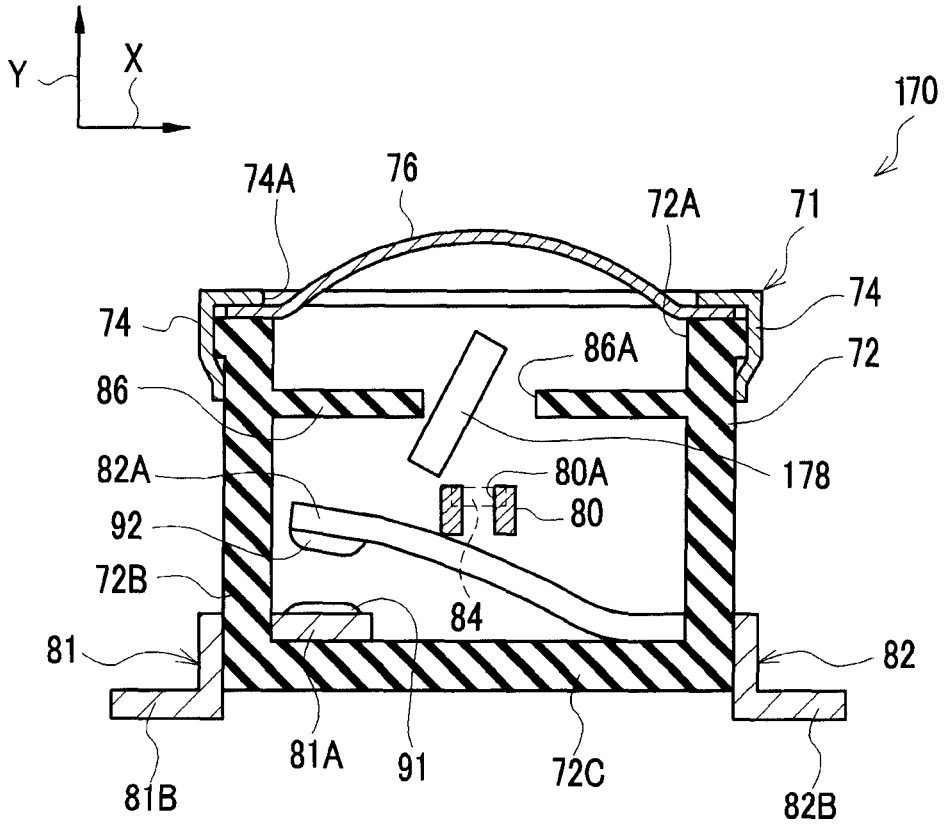

In the present exemplary embodiment, the movable pin 78 is constituted by the first pin 78A and the second pin 78B. However, a thermostat 170 related to a modification includes a movable pin 178 constituted by one pin as shown in FIGS. 7A and 7B. In addition, portions having the same functions as the thermostat 70 will be designated by the same reference numerals, and the description thereof will be appropriately omitted.

Figure 8:
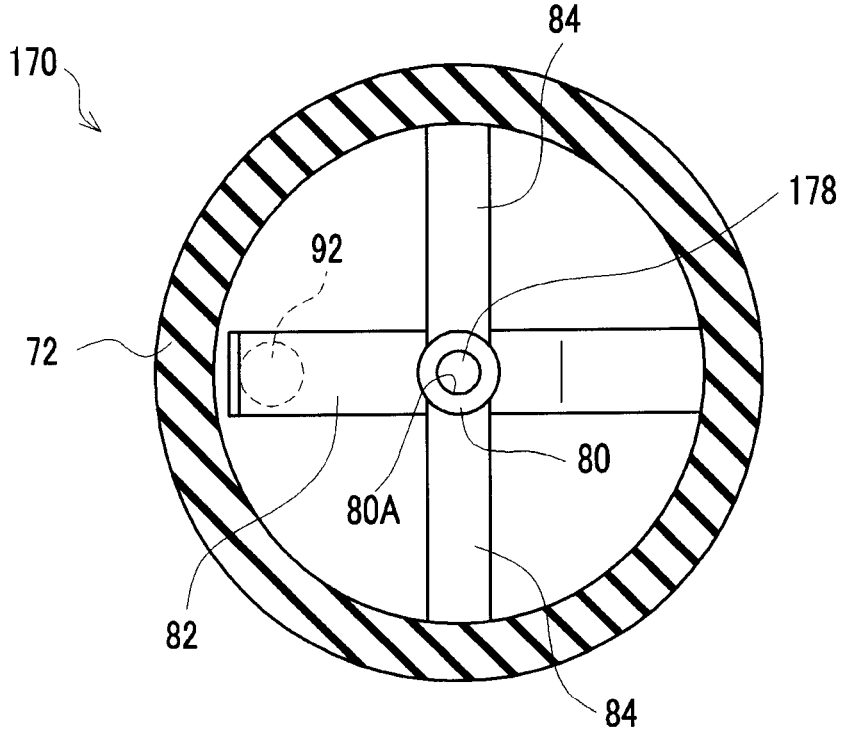
FIG. 8 is a cross-sectional view taken along a line 8-8 in FIG. 7A.

The movable pin 178 has the (the direction of the arrow Y in FIGS. 7A and 7B) axial length of the housing 72, and is formed in a columnar shape, for example. The movable pin 178, as shown in FIG. 8, is arranged at the central portion (center portion) of the housing 72 in plan view. The movable pin 178 is not fixed to any members.

Additionally, in a state where the movable pin 178 is inserted into the first pin guide 80, movement of the movable pin in the first direction (the direction of the arrow Y in FIGS. 7A and 7B) along the insertion hole 80A of the first pin guide 80 is permitted, and movement of the movable pin in the second direction (the direction of the arrow X in FIGS. 7A and 7B) is regulated by hitting the inner wall of the first pin guide 80 so that the movable pin is located at a position where a pushing force from the bimetal 76 can be transmitted to the second electrode 82.

Here, in the present exemplary embodiment, the movable pin 178 has one end (upper end in FIGS. 7A and 7B) pushed by the bimetal 76 in a concave state (state shown in FIG. 7A) that is made concave with respect to the outside of the housing 72, thereby pushing the second electrode 82 at the other end (lower end in FIGS. 7A and 7B) so as to bring the second contact 92 and the first contact 91 into contact with each other.

Additionally, in a case where the bimetal 76 is in a concave state, the movable pin 178 is inserted into the insertion hole 80A of the first pin guide 80, and the movement of the movable pin in the second direction (the direction of the arrow X in FIGS. 7A and 7B) is regulated by the first pin guide 80.

A resisting force against the urging force of the second electrode 82 stops acting on the second pin 78B by the convex displacement (state shown in FIG. 7B) of the bimetal 76, whereby the second pin 78B is moved to the bimetal 76 side with an urging force of the second electrode 82, and jumps out of the insertion hole 80A of the first pin guide 80.

According to the configuration of the modification, if the bimetal 76 is displaced (reversed) in a convex shape with respect to the outside of the housing 72, a resisting force against the urging force of the second electrode 82 stops acting, the second contact 92 moves to the bimetal 76 side by the urging force of the second electrode 82, and the second contact 92 and the first contact 91 are separated from each other. Thereby, the electric circuit 25 is interrupted and the supply of electric power from the power supply section 21 to the heat source 64B is stopped.

At this time, the movable pin 178 jumps out of the first pin guide 80 by the urging force of the second electrode 82, is released from the movement regulation of the first pin guide 80, and is removed from the first pin guide 80. That is, the movable pin 178 slips out of the first pin guide 80, and is thereby removed from a position where the pushing force from the bimetal 76 can be transmitted to the second electrode 82. Thereby, the movable pin 178 inclines with respect to the first direction (the direction of the arrow Y in FIGS. 7A and 7B) or falls downward due to its own weight.

In this state, even in a case where the reversed bimetal 76 is pushed and is returned from the outside, the movable pin 178 is not pushed by the bimetal 76, or is not inserted into the first pin guide 80 even if pushed. For this reason, the second pin 82 is not pushed by the movable pin 178, and the second contact 92 of the second electrode 82 and the first contact 91 of the first electrode 81 do not come into contact with each other. That is, even if the bimetal 76 is returned to a concave shape due to an external force, the interrupted state of the electric circuit 25 is maintained.

The invention is not limited to the above exemplary embodiments, and various modifications, alterations, and improvements can be made. For example, the modification shown above may be appropriately configured by plural combinations.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed:

1. A thermally-actuated switch comprising:

a housing;

a displacement member that is held by the housing in a concave shape with respect to the outside of the housing and is displaced in a convex shape with respect to the outside of the housing in response to temperature changes;

a first electrode that has a first contact provided inside the housing;

a second electrode that has a second contact provided between the displacement member and the first contact and that is urged such that the second contact is separated from the first contact to the displacement member side;

a movable member that is provided between the second electrode and the displacement member so as to be movable in a first direction directed from the second electrode side to the displacement member side, is pushed at one end by the displacement member in a concave state to push the second electrode at the other end to bring the second contact into contact with the first contact, and is moved in the first direction by an urging force acting on the second electrode due to convex displacement of the displacement member; and a regulating member that regulates movement of the movable member in a second direction orthogonal to the first direction from a transmittable position where a pushing force from the displacement member is capable of being transmitted to the second electrode, and releases the regulation such that the movable member moved in the first direction by the urging force is removed from the transmittable position.

2. The thermally-actuated switch according to claim 1, wherein the movable member includes:

a first member fixed to the second electrode; and a second member that is provided between the first member and the displacement member, and is pushed at one end by the displacement member in a concave state to push the second electrode via the first member at the other end to bring the second contact into contact with the first contact, and is pushed and moved in the first direction by the first member with an urging force of the second electrode due to convex displacement of the displacement member, and is released from the regulation from the regulating member so as to be removed from the transmittable position.

3. A fixing device that fixes an image onto a recording medium, the fixing device comprising:

a heating member that heats the image on the recording medium;

a circuit for supplying electric power to the heating member; and the thermally-actuated switch according to claim 1 that has the first electrode and the second electrode provided within the circuit, and that interrupts the circuit as the displacement member is displaced in response to temperature changes by radiant heat that is received from the heating member and the first contact and the second contact are separated from each other.

4. An image forming apparatus comprising:

an image forming section that forms an image on a recording medium; and the fixing device according to claim 3 that fixes the image formed on the image forming section onto a recording medium.

* * * * *